US007188683B2

(12) United States Patent
Ayling

(10) Patent No.: US 7,188,683 B2
(45) Date of Patent: Mar. 13, 2007

(54) DRILLING METHOD

(75) Inventor: Laurence John Ayling, Camberley (GB)

(73) Assignee: Coupler Developments Limited, Douglas (GB)

( * ) Notice: Subject to any disclaimer, the term of this patent is extended or adjusted under 35 U.S.C. 154(b) by 0 days.

(21) Appl. No.: 10/782,016

(22) Filed: Feb. 19, 2004

(65) Prior Publication Data

US 2004/0159465 A1 Aug. 19, 2004

(51) Int. Cl.
*E21B 19/16* (2006.01)

(52) U.S. Cl. ..... 175/57; 175/122

(58) Field of Classification Search ..... 166/322, 166/325, 81.1, 373, 374, 380; 175/72, 207, 175/218, 215, 209
See application file for complete search history.

(56) References Cited

U.S. PATENT DOCUMENTS

| | | | | |
|---|---|---|---|---|
| 2,245,960 | A | 6/1941 | Claire | |
| 2,758,654 | A * | 8/1956 | Simmons | 166/77.4 |
| 2,877,977 | A * | 3/1959 | Allen | 277/325 |
| 2,963,273 | A | 12/1960 | Failing | |
| 2,963,274 | A | 12/1960 | Failing | |
| 3,144,085 | A | 8/1964 | Hasha | |
| 3,190,370 | A | 6/1965 | Kvell-Aune | |
| 3,212,578 | A | 10/1965 | Hasha | |
| 3,282,339 | A | 11/1966 | Hasha | |
| 3,404,741 | A | 10/1968 | Gheorge | |
| 3,463,231 | A * | 8/1969 | Hutchison et al. | 166/303 |
| 3,486,560 | A | 12/1969 | Hutchinson | |
| 3,559,739 | A * | 2/1971 | Hutchison | 166/311 |
| 3,631,933 | A | 1/1972 | Bryant | |
| 3,722,603 | A * | 3/1973 | Brown | 173/159 |
| 3,722,607 | A | 3/1973 | Ray | |
| 3,757,858 | A | 9/1973 | Davis | |
| 3,797,570 | A * | 3/1974 | Leutwyler | 166/77.4 |
| 3,888,318 | A * | 6/1975 | Brown | 173/149 |
| 3,999,610 | A | 12/1976 | Sage | |
| 4,119,297 | A | 10/1978 | Gunther | |
| 4,162,704 | A * | 7/1979 | Gunther | 166/77.53 |
| 4,315,553 | A * | 2/1982 | Stallings | 175/207 |
| 4,427,070 | A | 1/1984 | O'Brien | |
| 4,512,216 | A | 4/1985 | Callegari | |
| 4,553,591 | A | 11/1985 | Mithchell | |
| 4,640,362 | A | 2/1987 | Schellstede | |
| 4,646,855 | A | 3/1987 | Dellinger | |
| 4,655,291 | A | 4/1987 | Cox | |
| 4,715,456 | A | 12/1987 | Poe | |
| 5,059,043 | A | 10/1991 | Kuhne | |
| 5,215,151 | A | 6/1993 | Smith | |
| 5,284,210 | A | 2/1994 | Helms | |
| 5,314,209 | A | 5/1994 | Kuhne | |
| 5,566,769 | A | 10/1996 | Stuart | |
| 5,662,170 | A | 9/1997 | Donovan | |
| 5,667,023 | A | 9/1997 | Harrell | |
| 5,679,894 | A | 10/1997 | Kruger | |
| 5,771,984 | A | 6/1998 | Potter | |
| 5,803,186 | A | 9/1998 | Berger | |
| 5,975,203 | A | 11/1999 | Payne | |
| 5,975,219 | A | 11/1999 | Sprehe | |
| 5,988,274 | A | 11/1999 | Funk | |
| 6,119,772 | A * | 9/2000 | Pruet | 166/81.1 |
| 6,352,129 | B1 * | 3/2002 | Best | 175/25 |
| 6,412,554 | B1 * | 7/2002 | Allen et al. | 166/80.1 |

* cited by examiner

*Primary Examiner*—Frank S. Tsay
(74) *Attorney, Agent, or Firm*—Ronald B. Sherer; Bartlett & Sherer

(57) ABSTRACT

A system and method is disclosed for continuously supplying drilling fluid down a bore hole while adding or removing tubulars.

15 Claims, 9 Drawing Sheets

Fig. 4 During "Drilling on" - With Kelly Drilling
*Coupler mounted below normal Rotary Table*
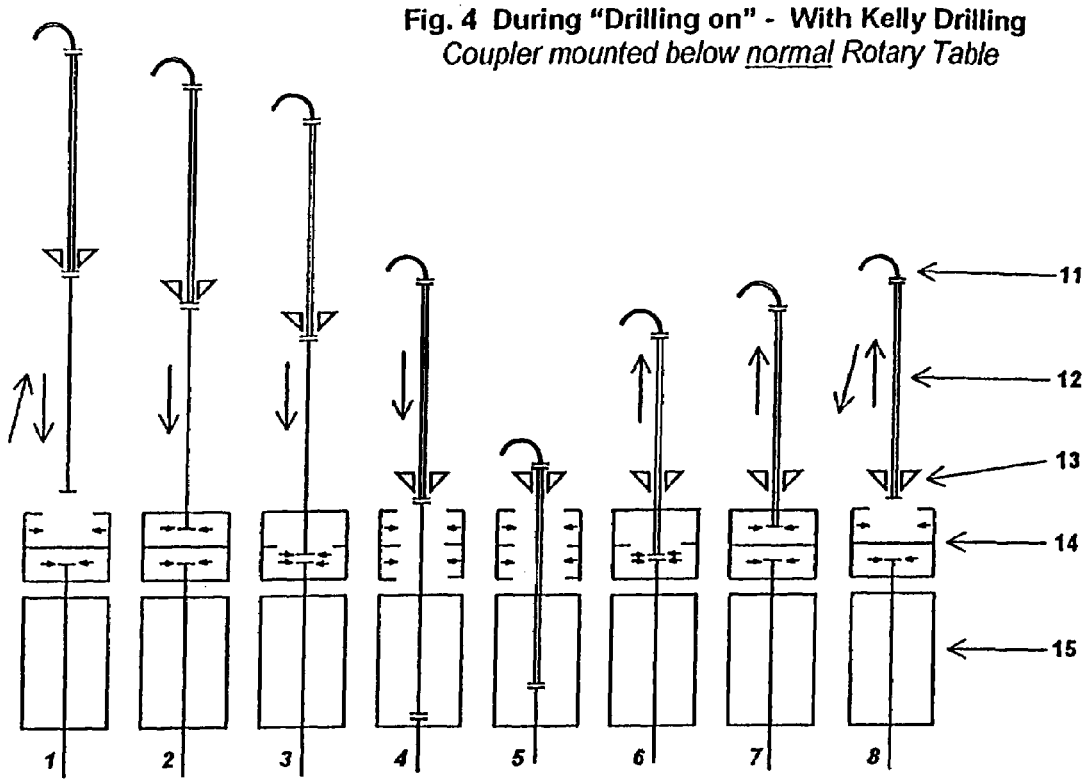
Fig. 5 During "Drilling on" - With Kelly Drilling
*Coupler mounted below elevated Rotary Table*
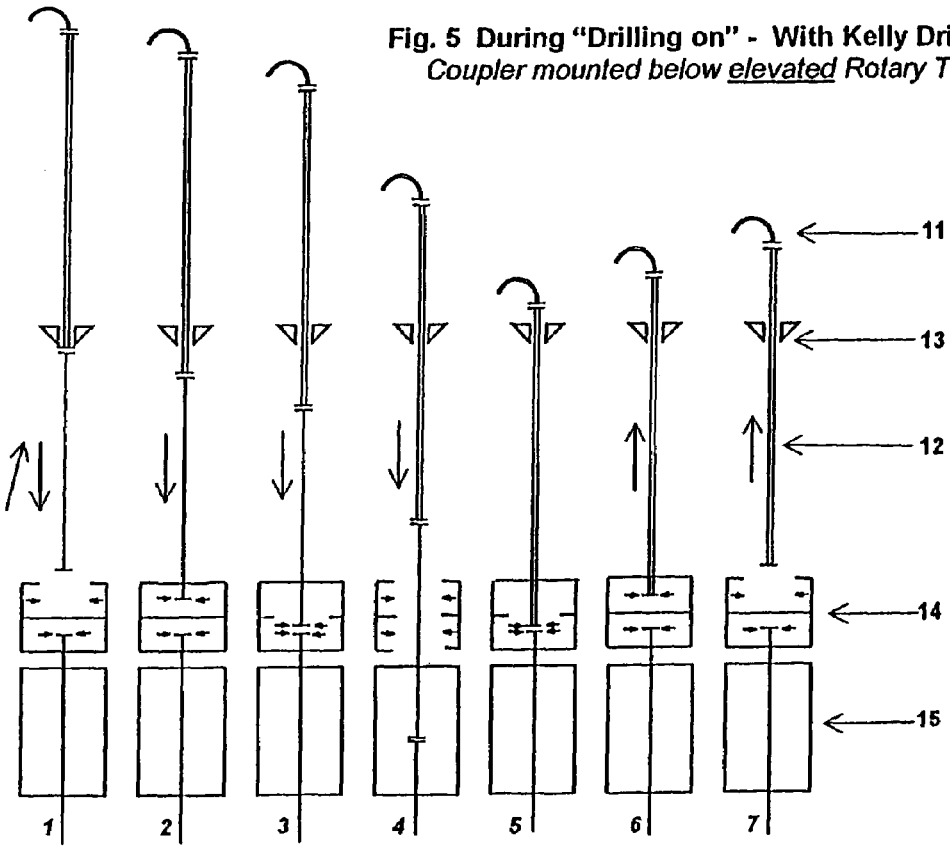

Fig. 6 During "Drilling on" - with Top Drive Drilling
*Coupler mounted on or below the Rig Floor*
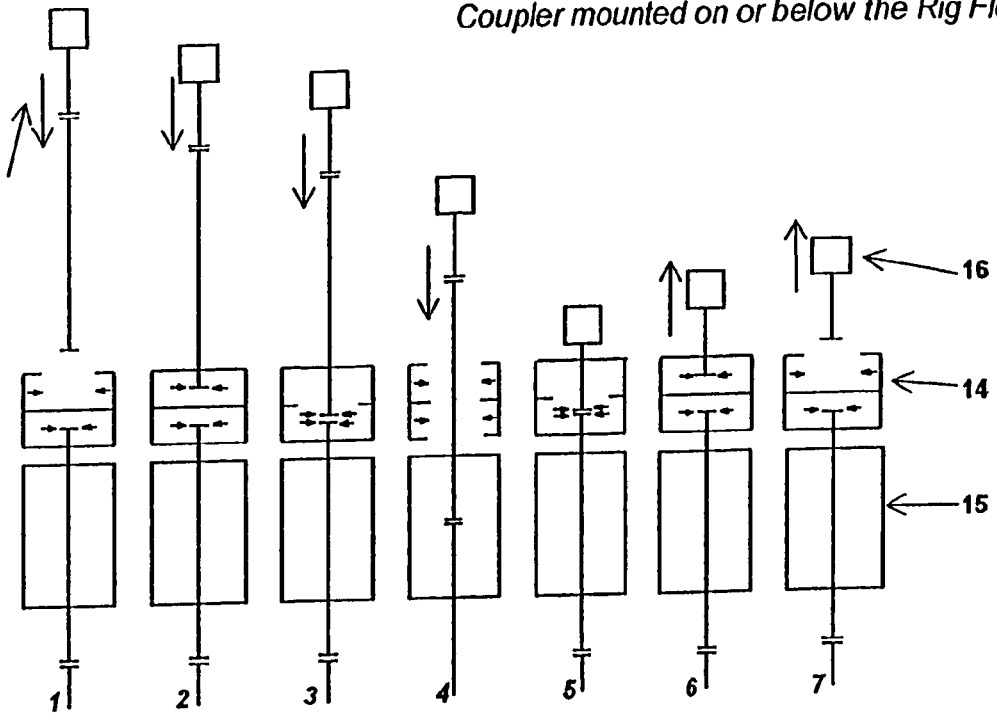
Fig. 7 During "Drilling on" - with Top Drive Drilling
*Coupler integrated with BOP Stack*
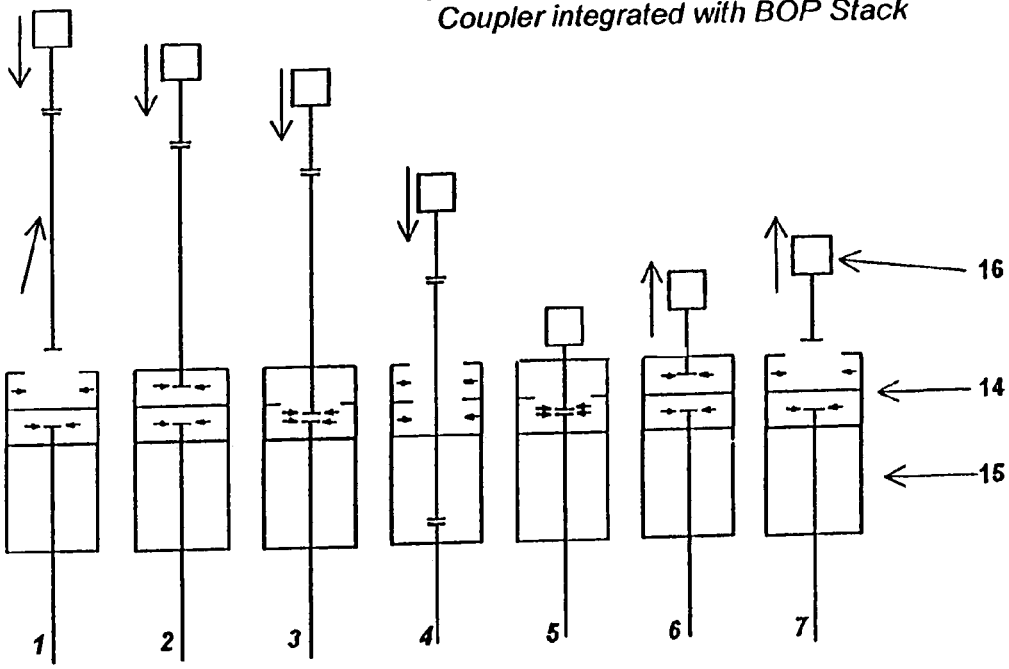

Fig. 8 During "Drilling on" – with a Top Drive
*Coupler mounted on a short hoist*
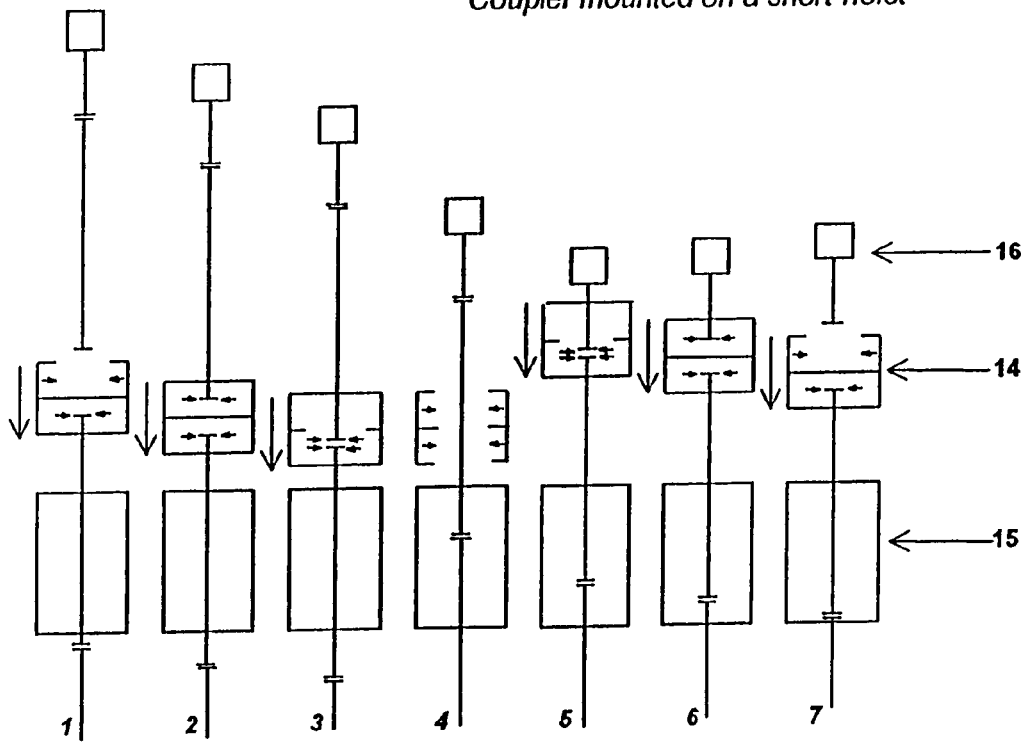
Fig. 9 During "Drilling on" – with a Bottom Drive
*Coupler mounted on a short hoist*
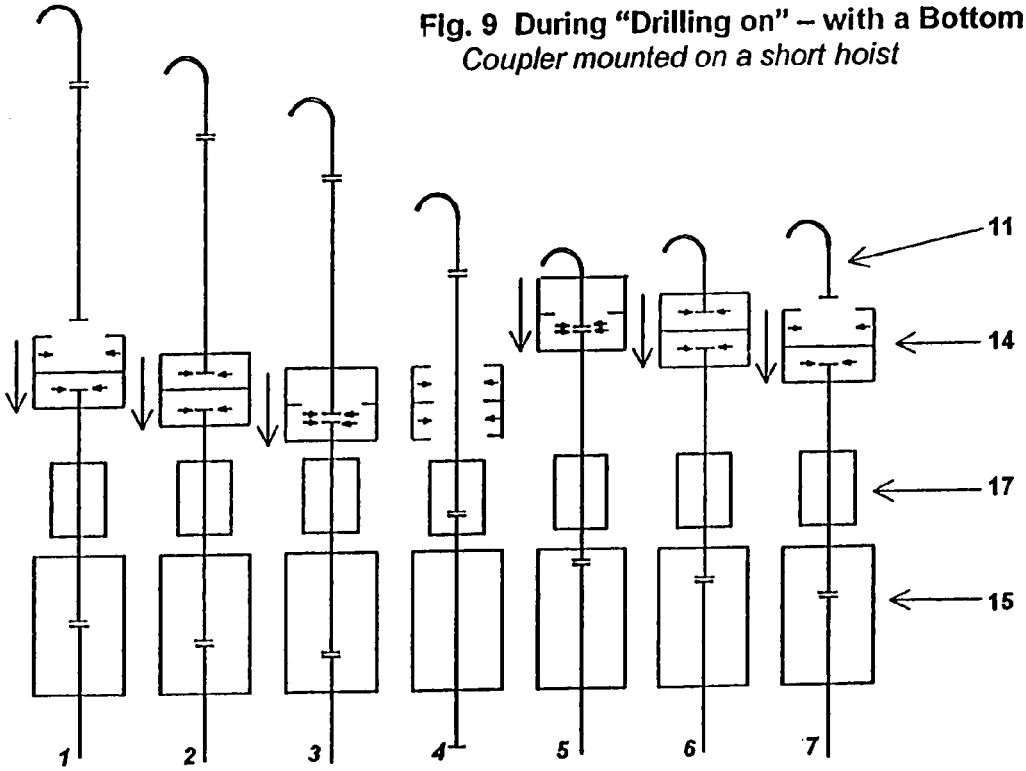

Fig. 10 During "Drilling on" – with a Mobile Rotary Table
*Coupler mounted on a short or long hoist plus Rotary Table on a long hoist.*
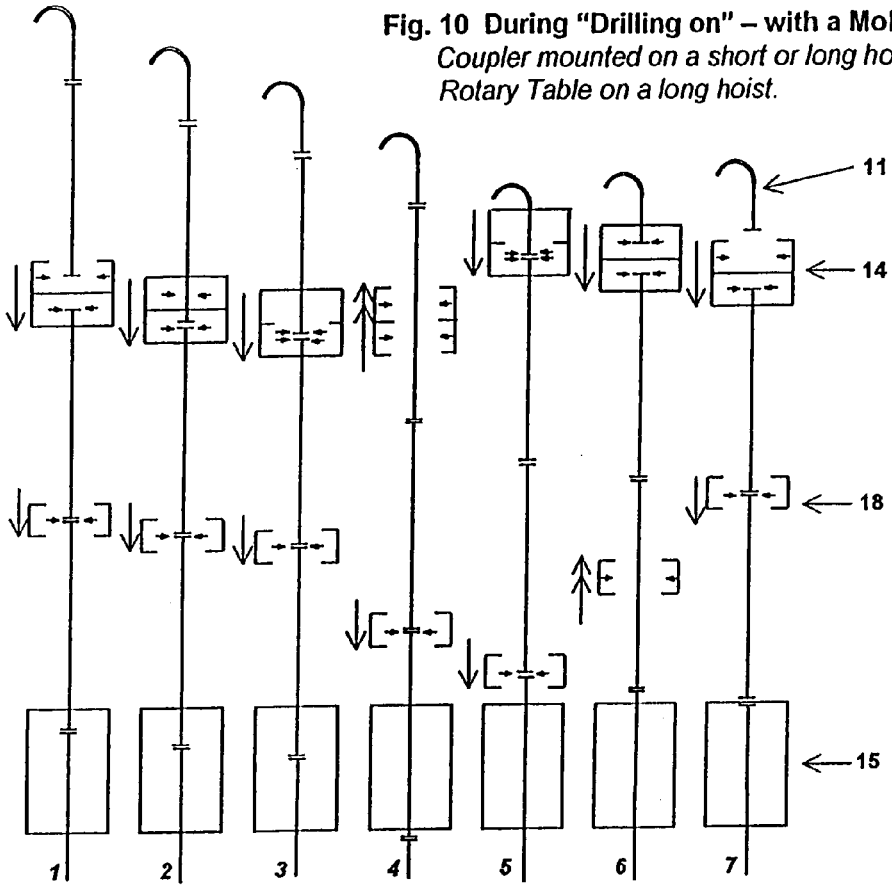
Fig. 11 During "Drilling on" without top or bottom drives
*Two Couplers with split bodies mounted on long hoists*
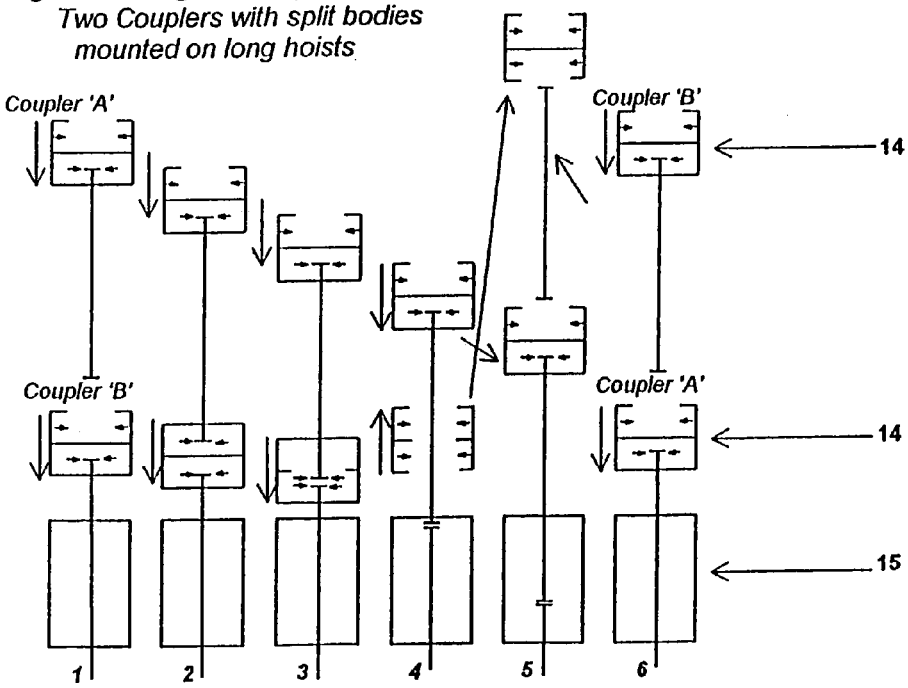

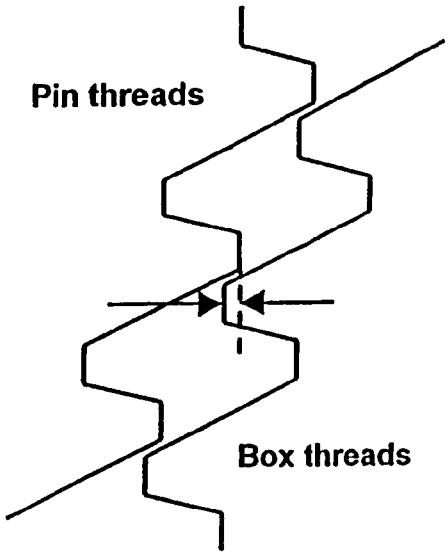
13 a
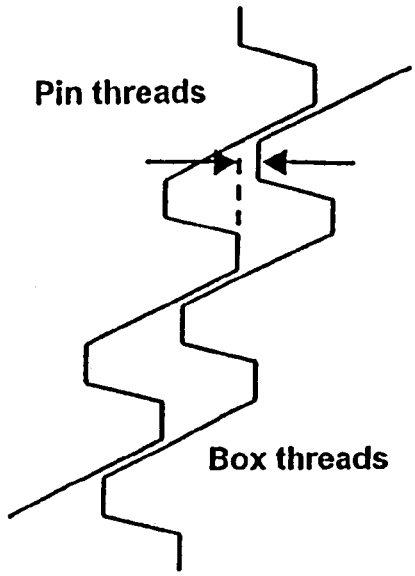
13 b
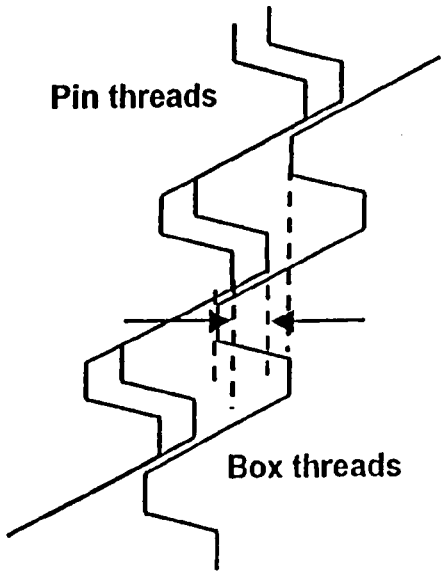
13 c
Fig. 13

DRILLING METHOD

The present invention relates to a method for drilling wells, particularly drilling for hydrocarbons.

In drilling wells for hydrocarbons, particularly petroleum, the drill string is rotated to drive the drill bit and mud is circulated to cool, lubricate and remove the rock bits formed by the drilling.

As the drill penetrates into the earth, more tubular drill stems are added to the drill string. This involves stopping the drilling whilst the tubulars are added. The process is reversed when the drill string is removed, e.g. to replace the drilling bit. This interruption of drilling means that the circulation of the mud stops and has to be restarted on recommencement of the drilling which, as well as being time consuming and expensive, can also lead to deleterious effects on the walls of the well being drilled and can lead to problems in keeping the well 'open'.

Initial Patent Application PCT/GB97/02815 of $14^{th}$ of Oct. 1997

A method for continuous rotation of the drill bit whilst adding or removing tubulars is described in patent Application PCT 97/02815

In this application there is provided a method for drilling wells in which a drill bit is rotated at the end of a drill string comprising tubular members joined together and mud is circulated through the tubular drill string, in which method tubular members are added to or removed from the drill string whilst the circulation of mud continues.

The method provides for supplying mud, at the appropriate pressure in the immediate vicinity of the tubular connection that is about to be broken such that the flow of mud so provided overlaps with flow of mud from the top drive, as the tubular separates from the drill string the flow of mud to the separated tubular is stopped e.g. by the action of a blind ram or other preventer or other closing device such as a gate valve.

The separated tubular can then be flushed out e.g. with air or water (if under water) depressured, withdrawn, disconnected from the top drive and removed. The action of the preventer is to divide the tubular connection into two parts e.g. by dividing the pressure chamber of the connector connecting the tubular to the drill string. The drill string continues to be circulated with mud at the required pressure.

In a preferred embodiment of the invention a tubular can be added using a clamping means which comprises a coupler, and the top end of the drill string is enclosed in and gripped by the lower section of the coupler, in which coupler there is blind preventer which separates the upper and lower sections of the coupler, the tubular is then added to the upper section of the coupler and is sealed by an annular preventer and the blind preventer is opened and the lower end of the tubular and upper end of the drill string joined together.

In use, the lower section of the coupler below the blind preventer will already enclose the upper end of the drill string before the tubular is lowered and when the tubular is lowered into the coupler the upper section of the coupler above the blind preventer will enclose the lower end of the tubular.

The tubular can be added to the drill string by attaching the lower section of the coupler to the top of the rotating drill string with the blind preventer in the closed position preventing escape of mud or drilling fluid. The tubular is lowered from substantially vertically above into the upper section of the coupler and the rotating tubular is then sealed in by a seal so that all the drilling fluid is contained, the blind preventer is then opened and the tubular and the drill stand brought into contact and joined together with the grips bringing the tubular and drill string to the correct torque.

The lower end of the tubular and upper end of the drill string are separated by the blind preventer such that the tubular stand can be sealed in by an upper annular preventer so that when the blind preventer is opened there is substantially no escape of mud or drilling fluid and the tubular stand and drill string can then be brought together and made up to the required torque.

To remove another tubular from the drill string the tubular spool or saver sub under the top drive penetrates the upper part of the pressure chamber, is flushed out with mud and pressured up; the blind ram opens allowing the top drive to provide circulating mud and the spool to connect to and to torque up the into the drill string. The pressure vessel can then be depressured, flushed with air (or water if under water) and the drill string raised until the next join is within the pressure chamber, the 'slips and grips' ram closed, the pressure chamber flushed with mud and pressured up and the cycle repeated.

Preferably the coupler includes rotating slips which support the drill string while the top drive is raised up to accept and connect another tubular.

The coupler may be static coupler connected to and above the wellhead BOP stack with a top-drive or mobile coupler handling the tubulars above the static coupler working hand-to-hand.

The coupler may be a mobile coupler disconnected from the wellhead BOP stack with a top-drive or second mobile coupler handling the tubulars above it working hand-to-hand and thereby allowing the string to move steadily in the vertical plane when tripping is in progress or allowing drilling to continue while a tubular stand is being added.

The coupler may be a mobile coupler disconnected from the wellhead BOP stack with one or more identical mobile couplers, above, which take it in turns to become the bottom coupler thereby working hand-over-hand and also facilitating steady movement of the string when tripping is in progress or drilling is continuing while a tubular is being added to the string.

The method disclosed in Patent Application PCT/GB97/02815 locates the grips and slips either inside or outside the coupler pressure hull.

I have now devised an improved structure and method of continuous drilling.

According to the invention there is provided a well head assembly which comprises a BOP stack above which there are positioned sequentially:

(i) a lower annular preventer
(ii) lower grips and slips adapted to engage a downhole drill string
(iii) a blind preventer
(iv) upper grips and slips adapted to engage a tubular to be added to the drill string; and
(v) an upper annular preventer in which the upper grips and slips are able to pass through the blind preventer when the blind preventer is in the open position.

This is illustrated in FIG. 1 of the accompanying drawings and the sequence of operation of adding a tubular to the string is illustrated in FIG. 2.

The Grips and Slips Function

The grips are the means of gripping the tubulars strongly enough to transfer a rotational force or torque, by friction surfaces shaped to fit the external surface of the tool joint, or the shaft of the tubular, or by powered rollers, both methods of which are common in conventional iron roughnecks.

The slips are the means of applying an axial force to the tubular to prevent it slipping, by wedge action and or by obstructing the passage of the upset of the tool joint, as is common in conventional slips.

The grips & slips combine the functions of gripping and slipping either by modifying the profile of the friction pads, rollers or slips or by integrating the separate grips and slips to operate in concert.

The orientation of the well head assembly refers to the well head assembly when in position on a drill string.

The gripping mechanism with or without integrated slips may be achieved by simply altering the materials and profile of the inserts of the conventional Rotary BOP, Diverter, Preventer, or Rotating Control Head. Alternatively the gripping may be achieved by conventional methods of wedge, lever, motorised rollers screw or other mechanical means caused by hydraulic, electrical or mechanical means such as is currently applied within collect connectors, casing tongs rotary power slips or current iron roughnecks.

In use, the invention enables a tubular to be added to a drill string when a drill string is rotating and drilling mud is flowing. The lower grips and slips grip support and rotate the drill string, the circulation of tubular string continues uninterrupted and over or under balanced pressure in well bore and annulus is maintained continuously. The upper preventer is open and the new tubular is positioned on the blind preventer, preferably there being a locating means so that the tubular is correctly positioned above the drill string e.g. by landing the tubular on a raised star on the blind preventer, i.e. the tubular is "zero indexed".

The upper preventer and upper grips and slips are then shut and the new tubular can have air (or water if the drilling is taking place underwater) replaced by the appropriate drilling fluid.

The blind preventer is then opened and the circulation (or reverse circulation) of tubular sting continued uninterrupted from two overlapping sources and over or under balanced pressure in well bore and annulus is maintained continuously.

The new tubular is then brought into contact with the drill string by passing through the blind preventer and is controlled by the upper slips and grips and, when the tubular is in contact with the drill string, the new tubular turns faster than the drill string so that the new tubular is "torqued up" by the upper grips and slips acting against the lower grips and slips, whilst both continue to rotate and the new tubular is screwed to the top of the drill string.

Preferably the new tubular is not rotating as fast as the string when it first makes contact with the string such that the jumping of the threads can be 'felt' and the acceleration of the rotation of the tubular can be initiated immediately after a jump is felt thus eliminating any possibility of cross threading due to lack of alignment or synchronisation.

The upper annular preventer and grips and slips are opened and the drill string lowered and the process can be repeated. To remove a tubular the sequence is reversed.

Variations on the Location of Slips and Grips

It is a feature of the method of PCT/GB97/02815 that either or both of the upper and lower grips and slips can be located inside or outside the pressure hull of the Coupler and that, if outside, then the function of the upper grips and slips may be carried out by a top drive and the function of the lower grips and slips may be carried out by a rotary power table and this is shown diagrammatically in FIG. 3.

The upper grips and slips, if outside the Coupler pressure hull can be a top drive or the upper section of an iron roughneck, (but with limited ability to snub a tubular against an internal pressure) or manual roughnecking (with no ability to snub against an internal pressure).

The lower Grips & Slips, if outside the pressure hull, can be a powered rotary slips, capable of supporting a tubular string, or the lower section of an iron roughneck with limited ability to support the weight of a tubular string, or a bottom drive of an unconventional type like the pipe gripping tracks used in offshore pipelaying.

The Upper and Lower Grips & Slips, if inside the Coupler pressure hull, can be rotary slips of the type developed by Varco B J or the gripping components of a conventional an iron roughneck, modified to support the weight of the tubular string and to rotate and torque the upper and lower boxes of the tool joint by differential gearing, thus allowing both boxes to continue rotating as they are connected or disconnected.

The Upper and Lower Grips & Slips, if inside the Coupler pressure hull can be above or below the blind preventer or pass through it when it is open. The preferred solution is to support the string with grips & slips, mounted in a large bearing in the lower section of the Coupler pressure hull and to grasp the tubular with upper grips & slips in the upper section, while it is filling with mud, and then move the tubular down through the open and ram to make the connection.

Operations Under High Internal Pressure

The required snubbing force, against maximum internal mud pressure is much higher than is possible by pushing the tubular into the wellhead using external forces. By using the pair of grips and slips in close proximity, the force lines are short and are contained within the massive body of the pressure hull. To enable the threads to be engaged without undue force, the vertical motion of the upper grips & slips is pressure balanced within the pressure hull.

It is the preferred solution to have both the upper and lower grips and slips located inside the pressure hull of the Coupler for several reasons, which include the following: (a) The gripping to takes place on the thicker wall of the tool joint box with its rougher surface and larger diameter, (b) The scaling takes place on the smoother surface and smaller diameter of the tubular shaft (c) The slips act positively on the upset shoulder of the box, (d) The path of the force lines is minimised, (e) The accuracy of the mating is maximised.

Concerning the making and breaking of tool joint connections under high pressure, even up to full pressure rating of the preventers, the possibility of "snubbing" tubulars into the well-head is practically impossible. Even for quite moderate pressures special handling equipment is necessary to snub tubulars into a pressured well head.

This invention, however, allows snubbing to take place by 'pulling' the two halves of the tool joint together within the Coupler instead of, as is currently the practice, pushing the tubular with external rigging. This invention allows tubulars to be added to the string even at the full pressure rating of the BOP stack.

To achieve accurate and controlled making and breaking of tool joints when subjected to high mud pressures, the two halves of the tool joint may be moved together, or apart, with minimum force, by pressure balancing the axial motion of the upper grips and slips as shown in FIGS. 1 and 2 which is preferred basic coupler solution.

Additionally, as the two grips and slips are so close together and within a massive body, the torquing of the one against the other is simplified.

The Basic Coupler Configuration

In the Basic Coupler, the grips and slips do no more than a conventional iron roughneck achieves but it is carried out under the pressure of the inlet mud during normal mud circulation. This is to hold the string still, while screwing in the tubular and then torquing up the connection to as much as 70,000 ft lbs. This invention enables this to be done under pressure inside the Coupler up to the full discharge pressure of the mud pumps or the pressure rating of the preventers, whichever is the lower.

This Basic Coupler enables mud circulation to continue uninterrupted while adding, or removing tubulars, which achieves most of the advantages of the new drilling method, such as steady ECD (Equivalent Circulating Density), good formation treatment and avoidance of stuck bits and BHAs.

The Basic Coupler can be assembled from proven iron roughneck and ram preventer components and requires little development. It is suitable for retrofitting onto most of the existing Rigs that employ Kelly Drilling. The Basic Coupler has to be located beneath the rotary table in order that the Kelly bushing does not have to pass through the Coupler. The Basic coupler therefore has to be designed to support the weight of the string during tool joint connections and disconnections. As such the sequence of Coupler Operations is as shown in FIG. 4.

The Rotary Coupler Configuration

In the Rotary Coupler, the two sets of grips and slips both rotate while connecting and disconnecting so that the string can continue rotating. The screwing and torquing of the tool is achieved by differential gearing which ensures that the torquing of the connection is independent of the torque required to rotate the string.

This Rotary Coupler enables mud circulation and string rotation to continue uninterrupted while tubulars are added or removed from the string, which achieves almost all of the benefits listed below.

The Rotary Coupler can be assembled from well proven iron roughneck, rotary power slips and rotary BOP components with a moderate amount of engineering development. It is suitable for retrofitting on most of the existing rigs that utilise Top Drive Drilling. As such the sequence of Coupler operations is as shown in FIG. 6. The possibility of integrating the coupler with the BOP stack reduces the overall height still further as shown in FIG. 7.

Kelly Drilling

In the case of Kelly Drilling, when connecting or disconnecting the Kelly to or from the string, the Kelly Saver Sub provides the gripping surface for grips to grasp, an upset shoulder for the slips to act on and a smooth shaft for the preventer to seal on.

In Kelly drilling the drilling itself has to stop while a new tubular is added to the string because the Kelly has to be retrieved from the hole, which raises the bit off the bottom by some 30 ft or more and, as such, it matters less that string rotation is not continuous. The majority of the benefits are still gained by the continuous mud circulation as already stated.

However it is possible, with this invention, to relocate the rotary table 30 ft higher so that the bottom of the Kelly reaches the Coupler when it is time to add another tubular the string. By this method the bit can remain on the bottom while adding a new tubular to the string. This would normally invite problems but continuous mud circulation avoids the settling of cuttings and debris around the bit and BHA. This is shown in FIG. 5.

So, provided that a bumper sub (or thruster) is included above the drill collar section, drilling can continue, provided that the bit can rotate. If a Basic Coupler is used then continuous bit rotation requires a mud motor utilising the continuous mud circulation now available. If the bit is rotated by the string then a Rotary Coupler can be used to maintain string rotation. Either way, and, subject to relocating the rotary table and/or Kelly bushing rotating system, drilling on most rigs, which employ Kellys, can now be continuous, with or continuous string rotation.

Top Drive Drilling

In Top Drive Drilling, the Basic Coupler similarly enables continuity of mud circulation and drilling provided that a mud motor is used. If no mud motor is used continuous drilling is possible if a Rotary Coupler is used. In either case little modification is required to install a Coupler on a rig using Top Drive Drilling.

In Top Drive Drilling, there is the alternative shown in FIG. 8 where the Coupler is mounted on a short hoist to follow the drill bit down during connections and eliminate the need for a bumpersub. Whereas this is a heavy mechanical feat, it eliminates the problem that bumpersubs wear out quickly and that the bit weight, during connections, has to be pre-set.

Underbalanced Drilling (UBD)

The invention has the advantage that the rotation of the tubing and circulation of fluids can be continuous, over to underbalanced pressure can be maintained continuously and over or underbalanced drilling is possible without interruption, the tubing string bore is never open to the environment and the method is easier than existing methods to automate. The method can also eliminate the need for heavily weighted muds and the exposed well bore is less likely to collapse. The ease of transition from Drilling Coupler to casing Coupler eliminates the need to employ damaging kill fluids between drilling and casing.

Future Drive Systems

Future drive systems are anticipated where the drive will be 'Bottom Drive' probably by the type of pipe tensioning tracks that are used in offshore pipe laying, where very high axial tensions are transmitted to the pipe. If such a mechanism were to be rotated then the Sequence using a Coupler would be as illustrated in FIG. 9.

Total elimination of Top Drive and Bottom Drive Systems would be possible with a Coupler and a Rotary Table both mounted on long hoists one above the other as shown in FIG. 10. This requires a considerable vertical travel but no more than is used conventionally to stack of doubles and triples. The benefit of this system is that tripping can be carried out in a smooth steady operation, which benefits the downhole hydraulics, accelerating slowly to a velocity that is very much higher than is currently possible and an overall duration that is far shorter. Again, minimising damage to the exposed formation will usually be more valuable than the time saved. Continuous tripping can achieve the time saving without damaging the exposed formation.

The longer term future application of the Coupler as anticipated and described in PCT/GB97/02815 is as a Coupler that splits vertically and of which two can work hand-over-hand as in FIG. 11. Such Couplers will benefit from 'weight engineering' to reduce their mass and clever engineering design for the closing and latching mechanisms but they offer the best opportunity to simplify the total rig design and achieve the fastest tripping times. They can flexibly handle singles, doubles or triples or varying lengths of tubular assemblies including BHAs with large diameter components such as centralisers and under reamers and can be interchangeable and even operate hand-over-hand in threes. They eliminate all other drives, drawworks and swivels and could be mounted on the ground without any rig structure. However they are likely to be mounted on hydraulic masts.

Drilling and Casing Couplers

Both the Basic and Rotary Drilling Couplers can handle a range of tubular diameters from below 4 inches to about 7 inches. It is intended that two or more casing couplers will handle a range of casing diameters from about 9 inches to 20 inches or more including stab, twist and squnch joints.

All Couplers require the preventers to actuate far faster than is normal, which can be achieved by adding a secondary low pressure/high flow hydraulic system connected with high pressure valves than can only open under a low pressure differential. Thus the past motion actuation is achieved by the low pressure/high flow system and the high closing force is achieved by the high pressure/low flow system.

All Couplers require a compliant landing surface on the top of the Blind Ram blade, such that the impact of the pin of the tubular on the blade is absorbed without damage to pin or blade and that the landing surface is star shaped so that the tubular can be easily flushed out with mud, or air, or water while still in contact with the blade.

The casing Coupler is of significant value in Underbalanced Drilling since it is possible to leave the well, prior to casing it, in a steady and controlled pressure regime without having to introduce weighted mud to kill the well, which usually damages the exposed formation, which is to produce later.

Mud Quality and Doping

All Couplers require "doping" of the threads prior to connection and this may be achieved by one or more high pressure mud jets set in the Coupler body impinging on the rotating pin and box immediately before coupling.

The mud is required to be free of particulates or fines above a given screen mesh size and heavy weighting material is unlikely to be required when drilling with Couplers. In the event that significantly size particulates cannot be economically filtered out, fresh mud can be specially piped under high pressure to the said jets for activation briefly as the pin and box come together.

Mechanical Details

All Couplers assist in centralising and aligning the tubular and string axially and the stand off distance of the pin from the box is set by zeroing the pin against the blind ram blade. However, variations in the height of the box from the upset shoulder to the top surface of the box will not matter since the tubular is inserted with only enough force to seat the threads without damaging them and the acoustic or mechanical signal of the jumping of the threads is the signal to proceed with screwing up, as explained before.

Although the Coupler is able to centralise the tubular and string onto the centre line of the Coupler within reasonable accuracy as does a conventional roughneck; the centre line of the pin thread may be eccentric to its tool joint and the box thread likewise. Additionally the tubular and string may not be completely aligned axially. The initial landing of the pin threads on the box threads may therefore often cause high point loading between threads, which is the common situation with conventional drilling with Kellies or Top Drives which often damages the threads.

It is intended in this invention that the Tubular and String are brought together in a more controlled method which will avoid the possibility of damaging the threads of either the pin or the box.

This is first achieved by using the upper grips and slips to insert the pin into the box in a pressure balanced situation where the force necessary to move the tubular downwards is minimal. Additionally hydraulic oil pressure as shown in FIG. 1 compensates for various different tubular diameters, which would otherwise upset the predetermined pressure balancing ratio.

As referred to elsewhere, the method of orientating the tubular relative to the string can be achieved by an anticlockwise rotation of the pin relative to the box until the threads jump, which can be detected mechanically of acoustically after which the pin and box can be made up. In the Basic Coupler, the String is static and the tubular is rotated anticlockwise to reach the jump point. In the Rotary Coupler, the string is rotating so the tubular is static until the jump point is found. By making up the connection from a small rotation anticlockwise from the jump point, any possibility of cross threading is minimised.

However, this does not avoid the high stresses possible when initially landing the pin in the box and it is the intention with this Coupler to take advantage of the more automated process and improve control of this particular activity of landing the pin in the box. In this invention it is planned to ensure that the Tubular and String are relatively orientated in azimuth, such that the tapered threads of the pin and box avoid the situation where they collide with too little overlap of threads to absorb the shock without plastic deformation.

The insufficient overlap of threads can either occur on the landing surface as shown in FIG. 13*a,* or it can occur due to impact with the thread above, particularly if the pin and box are not concentric, as shown in FIG. 13*b*. FIG. 13*c* indicates the range of safe operation to avoid either of the above damaging situations.

It is estimated that just being in the preferred half of a rotation would very greatly reduce the thread damage that is currently experienced. To pick on the best relative orientation will almost eliminate such damage. The specific best orientation will vary with thread design but all tapered threaded connections will benefit from this method.

The marking of the pins and boxes to identify the best relative orientation can be carried out using a matching master pin and box and marking up the tubulars on site regardless of their source of supply.

The actual marking cannot be visible since the string may be totally enclosed and must be picked up mechanically or electrically. The simplest method being to produce a structural change on the shaft of the tubular, within inches of the upset shoulder between the surfaces acted upon by the slips and the RBOP seal. This structural change (bump, weld, or signal emitter, etc.) can then be detected (for example, mechanically, acoustically, electrically or radiographically) and the upper grips and slips can orientate the tubular accordingly. By this method the finding of the jump point, which is how threads are usually orientated manually, is not necessary. By this method of marking the best relative orientation for the optimum landing of pin in box is achieved, which is facilitated by this mechanised approach to Coupling. The combination of the Coupler's internal design and the improved method of physically inserting the pin in the box, should provide much faster coupling, plus improved repeatability and reliability and therefore reduced cost and improved safety.

Offshore and Subsea Drilling

In offshore drilling in particular, by using the couplers, the number of casing strings may be reduced and/or reach of the drilling vertically and horizontally may be increased significantly.

In deep water drilling, where conventional drilling is very costly, the use of such couplers, which isolate the tubular string from the marine environment may be used to great advantage in "Riserless Drilling" which is currently under development.

In very deep water, where drilling is currently uneconomic, the application of these couplers on drilling rigs of the future which will be located on the sea bed, will be of great value.

Increasing RBOP Seal Life

Concerning the routine change out of the Rotating BOPs, it is preferred that the BOP stack itself is mounted above a diverter so that the BOP stack RBOP may be changed out without opening the well bore to the environment. As has been explained, this RBOP is intended, according to the invention, to be operated at lower differential pressure, low sealing force and wet on both sides so that the rate of wear is greatly reduced. Additionally it may reduce its sealing force as a tool joint passes through whenever the RBOP above it is closed, thus increasing the life of the stack RBOP seal. Preferably the wellhead drilling assembly consists of a near standard BOP stack, including a stack RBOP, on top of which is connected a coupler consisting of the lower RBOP, a lower slips and grips unit, a blind ram or diverter and an upper slips & grips unit above this is connected the upper RBOP.

Hence the upper RBOP can be most easily changed out with the string supported in the lower slips and grips and sealed of by the blind ram. The lower RBOP can also be changed out without difficulty, but this may only be required once during the drilling of a well and can be done when a bit or bottom hole assembly has to be inserted into the well or changed out. The upper slips and grips of the coupler will have the ability to move vertically in order to connect or disconnect a tubular to or from the tubular string. The upper RBOP can optionally be a double RBOP in order to have a back up seal and the ability to test the lower seal for excessive leakage.

BHAs and Large Diameter Components

Since in drilling rig couplers both RBOP assemblies are required to work primarily on drill pipe, it is economic to design the operation such that it is not required for them to pass the larger diameters of tubular components such as drill collars, bits and reamers. Hence provision is preferred for the insertion and removal of such larger diameter components without passing through the coupler.

It is preferred therefore that when inserting or removing, large diameter components, the drilling coupler be removed. To do this without connecting the well bore down the well to the environment above ground or mud line, requires that a through bore valve or diverter is placed in the well at depth below ground level or mud line that allows a complete bit or down hole assembly to be installed, inserted or contained in the well above it. This will be required at an early stage but usually not before the 20 inch casing has been installed and it could be that the, so called, down hole diverter can be of the same bore as the largest BOP to be used during the drilling, maybe 13⅜ in. If, because of the pressure rating perhaps, the diverter cannot fit within the 20 inch casing then the 20 inch casing may have to be hung off, latched and locked at the level of the diverter with the next casing up, perhaps 24 in., sized at the full well pressure rating from the diverter level to the wellhead.

The diverter used in this application can have inserts installed to match the casing program such that, as each casing is installed the diverter internal diameter is reduced and the diverter can shut in the well at various sizes, e.g. from 13⅜ in down to production tubing size.

It is only required that the diverter operates down to the internal diameter of the drilling coupler. Such a diverter has been disclosed.

The down hole diverter allows the lower RBOP and stack RBOP to be changed out without opening the well to the environment and without having to operate one of the BOP stack rams. The down hole diverter allows the BOP stack to be changed out and the well to be completed with a production tree, without opening the well to the environment and hence there is never a need to circulate kill fluid into the well to hold it in.

Concerning safety, the down hole diverter, set as much as 300 ft or so down the well also provides an extra barrier to the down hole safety valve (DHSV) and is similarly a convenient cut off location, clear of seabed sloughing, iceberg scour, beam trawling and, on land, earthquakes, storm damage and the like and sabotage.

Concerning the installation of casings; once one is approaching likely hydrocarbon horizons with, for example a 20 in. casing already installed and a 13⅜ BOP stack in place, then, when withdrawing the drill string while continuously circulating and rotating as described earlier, the string is removed until only the bit assembly is still within the well, at this point the circulation can be stopped and the diverter closed below the bit. The string is gripped or hung off within the BOP stack and the two RBOP assemblies removed. The bit assembly is then removed from the well and the running of the casing commences.

Before running the casing, instead of the drilling coupler a single large diameter drilling coupler is installed above the BOP stack to allow each casing to be connected to the casing string without opening the well to the environment. This drilling coupler consists of an annular RBOP with, on top of it, a lower casing slip & grips, a blind ram, an upper casing slips & grips and an upper RBOP. Each stand of casing has a casing head allowing the circulation of fluid down the well and the returning fluid is contained by the stack RBOP and flows to the mud processing unit which is itself totally enclosed (as are most processing plants). The casing is installed and connected the same way as the drill pipe but the need for high torque is absent and many variations to the method of connection such as stab and squnch can be handled by the casing Connector.

The stability of the uncased hole still benefits greatly from continuous pressure maintenance plus continuous mud circulation and continuous rotation; all of which maintains the wall of the exposed formation in the optimum steady state regime that has been established since it was first drilled. Only when the string has been fully installed and the cement has been circulated to the required location is the rotation of the casing stopped. This casing rotation assists greatly the creation of a continuous unbroken cement job.

It is envisaged that such special casing couplers will exist for all casings up to as much as 20 inch casings, where shallow gas or shallow water may be present, down to 9⅝ inch and possibly 7 inch liner for example, two or three casing couplers will probably encompass all casing diameters up to twenty inches. For the 7 inch and smaller strings, either of the two drilling Couplers can be used with appropriate insets on the slips and grips.

There is the option under water to make up the entire bit or downhole assembly of some 100 to 300 ft and lower the entire assembly into the well in one operation. Above ground, however, it is assumed that this is not likely to be a preferred as making up the assembly in convenient lengths of 30, 60 or 90 ft or so at a time and connecting and torquing them up they pass down through the BOP stack. As such provision has to be made to grip and support the string within the BOP stack while the top drive (or side drive or bottom drive) adds another section. If the BOP stack is to be reserved for its traditional role then a simple and near conventional slips & grips assembly can be installed above the BOP stack to achieve this instead.

System Engineering

The structure of the invention is a coupler and it is a feature of the invention that the basic or rotary coupler may, with minor modification, be used in conjunction with a top-drive or bottom drive or one or more couplers to achieve hand-over-hand or hand-to-hand operations with the bottom coupler being static or mobile during the connection or disconnection of tubulars.

The whole purpose of the above equipment and methods is to use "off the shelf" components and tried and tested methods as much as possible; but to combine these in such a way that the well bore, at least from the 20 in casing onwards, is never again opened to the environment. This then eliminates the one situation, which currently requires that an additional barrier is placed in the well, that of the heavy kill fluid, of which the reliability is naturally limited to only one pressure i.e. the static head of the mud chosen.

By contrast, with the new method the weight of the fluid is chose specifically to achieve the correct 'pressure gradient' from the top to the bottom of the wall of the exposed formation. The actual pressure at the exposed formation is set by the inlet and outlet pressures at the wellhead and these can be set at will, changed immediately and can be kept continuous, while tubulars and tubular components of all sorts can be added or removed from the string and the strings themselves can be changed out as well, without disturbing, the optimum steady state.

Preferably the coupler is as short as possible to minimise the overall BOP and coupler height beneath a drilling derrick and the mobile coupler is as light as possible; the invention achieves this by integrating each slips and grips into one unit and by allowing the upper grips and slips to pass through the open blind preventer to meet up with the lower slips and grips and by combining the space required for the upper slips and grips with the space required for flushing the mud in or out.

Interpretations

All vertical motions may be carried out at an angle to the vertical as in the case of slant drilling where the wellhead is set at an angle to the vertical.

All references to a drill string apply equally to a casing string or production string or stinger or snubbing pipe or any other tubular made up of discrete lengths.

All references to a tubular apply equally to a single tubular or a stand of two or more tubulars.

All references to drilling mud apply also to all fluids that are pumped into the well bore for any purpose during the drilling and life of the well.

All references to the environment apply equally to drilling underwater as they do to drilling in air.

Benefits of the Coupler

It is feature of the invention that:

1. There is greater drilling efficiency because the tubulars can be added to the string without interrupting the drilling (so there is no delay while a tubular is added and the optimum drilling status is being re-established). The drilling continues steadily and continuously at the optimum conditions so that the fullest attention can be concentrated on small adjustments to but weight, rotary speed, bottom hole pressure, circulation rate and mud composition etc; to improve ROP. With steady state drilling, small deviations in downhole measurements are much easier to identify and interpret, particularly as the density, and temperature of the annular mud is now keep steady and consistent. MWD and PWD are more effective since they are contiguous and are of significant importance against a steady state background. Continuous drilling at steady optimum conditions increases but life and reduces the damage that often occurs when returning the bit to bottom either impacting the rock or grinding through several feet of debris.
2. There are fewer Drilling Problems because continuous circulation keeps the cuttings on the move so that settlement around the bit and bit assemblies does not occur and the cuttings density is constant throughout the annulus. With no cuttings settlement, stuck bits or BHAs, or string differential sticking, the need for hole cleaning is almost eliminated. With continuity of downhole pressure regime, variations of pressure at the exposed formation wall are very greatly reduced and almost eliminated, resulting in far less losses or wall instability.
3. Safety is increased because: Identifying small variations in pressure, flow, temperature, and density are very much easier with steady state background conditions and improve well control. Continuous closure of the string improves safety and also allows the string to be run back to bottom if needed in extreme kick conditions while circulating continuously. Continuous circulation under any desired pressure, regardless of the current mud weight, allows improved and immediate response to kicks.
4. There are lower Drilling Costs per Well because: With no interruptions to drilling when adding tubulars, with continuity of drilling at steady state optimum conditions, with longer life of the drilling bits, with much less chance of stuck bits, BHAs & drill string, with less costly mud weighting and gel components in the mud, with better downhole measurement & control and safety, the drilling costs per well should equate to a saving of several days on most wells, to weeks on extended reach wells and/or in difficult formations. Secondly, on platform rigs drilling several holes in succession, the overall additional early production is very significant to the DCF return on investment. The savings can be equated to those quoted for Coiled Tubing, to which can be added the benefits of string rotation. Additionally the assembly can be retrofitted to all current rigs that use top drive, which provides the potential for a very large saving in drilling costs to the Drilling Industry worldwide.
5. Hole Quality is improved because: by drilling continuously, with steady state down hole conditions, the exposed formation wall is subjected to less damage from 'pumping' of cuttings, finds and mud components into the formation and the quality of the producing formation is improved.

These benefits can result in very large operators' savings per rig particularly in deviated wells off shore and can amount savings per rig amounting to several million dollars per year.

The invention is described with reference to the accompanying drawings which are not to scale:

FIGS. 4 to 11 show sequences of adding a tubular in various different applications FIG. 12 shows a BOP configuration for use in conventional drilling rigs to achieve continuous pressure control whilst inserting or removing BHAs from the well or when switching couplers and FIG. 13 shows thread alignments.

Figure 1:
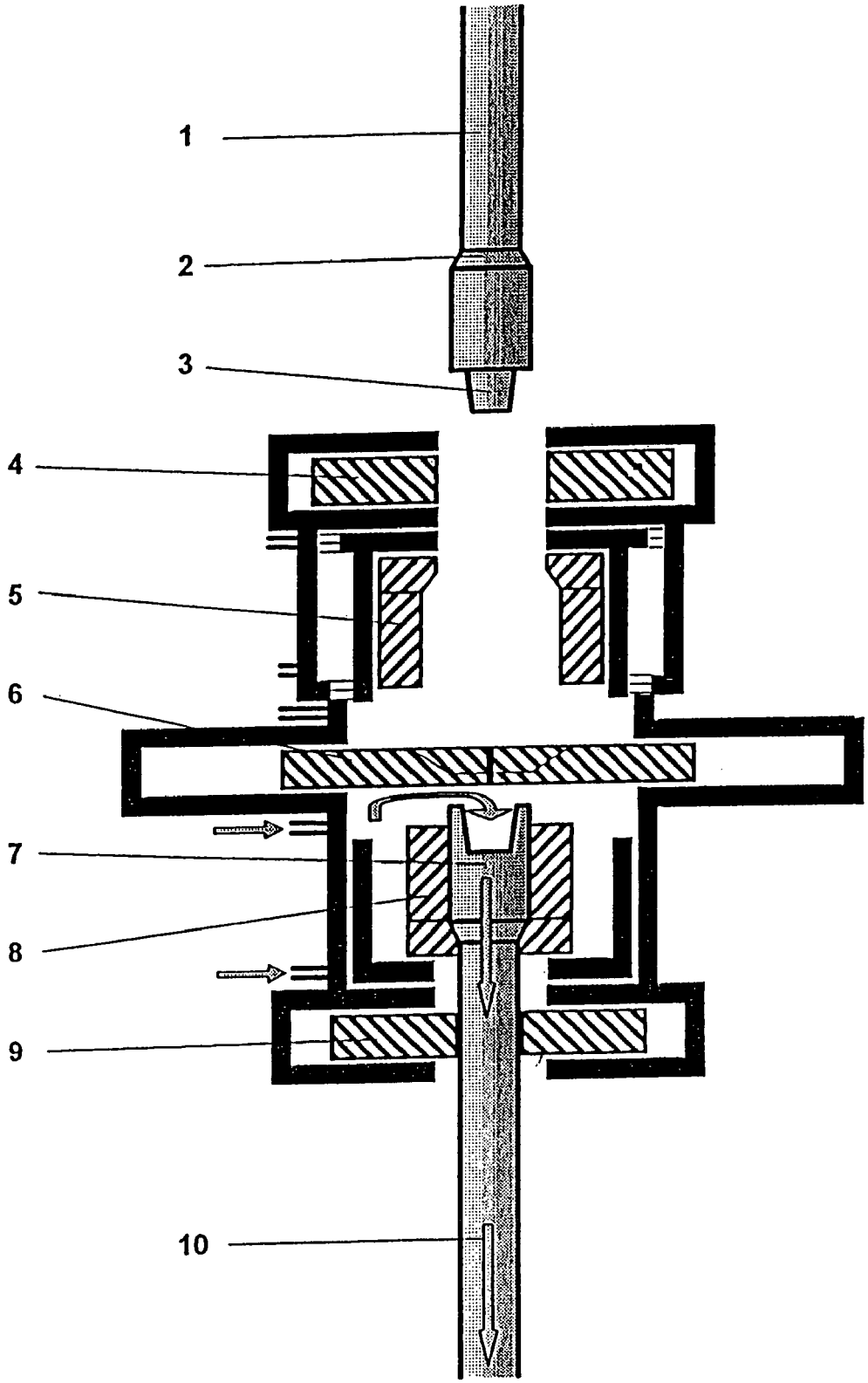
FIG. 1 shows an arrangement of the present invention

Referring to FIG. 1 a tubular (1) having an upset shoulder (2) and pin (3) is to be connected to drill string (10). The coupler of the invention has an upper RBOP of pipe ram (4), upper grips and slips (5), blind ram preventer or diverter (6), box (7), lower grips and slips (8) and lower RBOP or pipe ram (9). In FIG. 1 the blind ram (6) is closed. The mud, air and hydraulic fluid is circulated as shown so there is continuous circulation of the mud and rotation of the drill string.

As can be seen in FIG. 1 the grips and slips (2) pass through the preventer (3) when the preventer (3) is open.

The couplers and/or the top drive may be designed to move laterally to remove or fetch a tubular. Preferably a separate tubular handling system removes or offers up a tubular to the coupler or top-drive and performs the link with the function of storing or stacking tubular stands.

Figure 2:
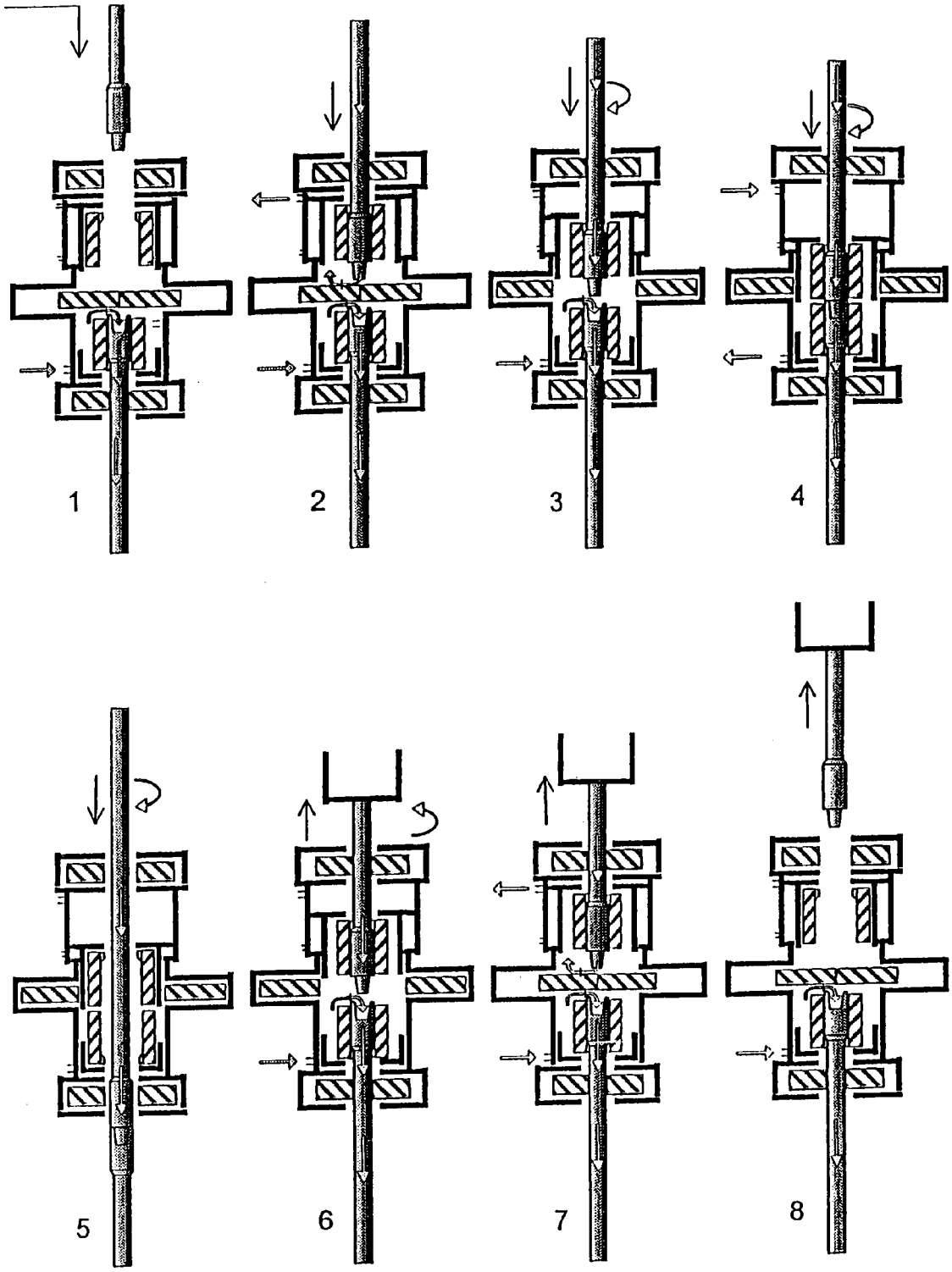
FIG. 2 shows the sequence of adding a tubular

Referring to FIG. 2 the sequence 1 to 4 is followed to connect the tubular to the string and the sequence 5 to 8 followed to disengage a tubular. In 1 the top of the drill string gripped by the lower grips, in 2 the tubular is gripped by the upper grips and slips in 3 the blind preventer is opened and the tubular rotated, in 4 the tubular and the drill string are engaged and the tubular rotated faster than the drill string and torqued up to make the connection and the upper an lower slips and grips disengaged. To remove a tubular this process is reversed as shown in 5 to 8.

Figure 3:
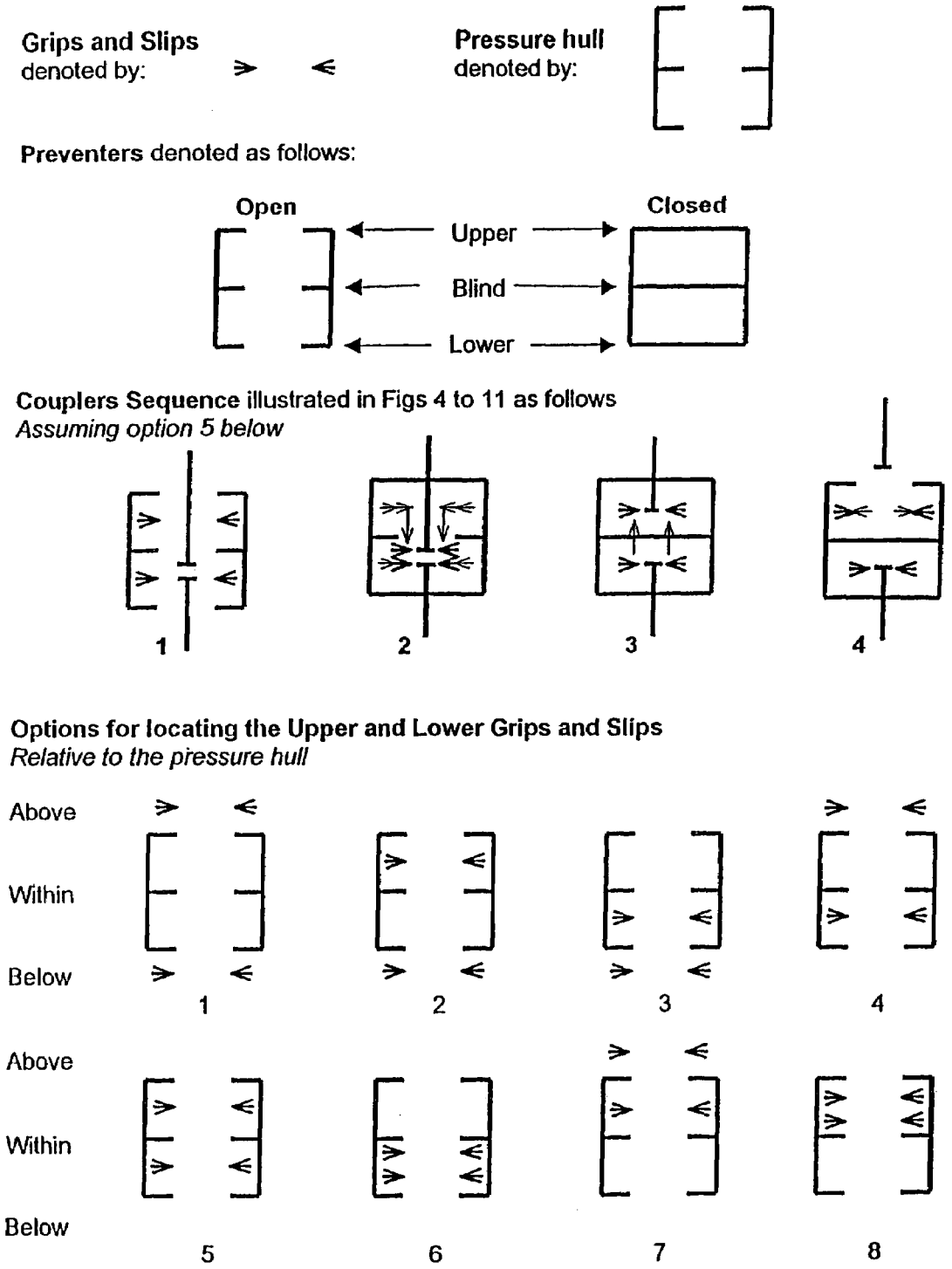
FIG. 3 shows the grips and slips options

Drilling sequences are illustrated diagrammatically in FIG. 3 and options for the location of the grips and slips above, within or below the coupler pressure hull are shown diagrammatically.

FIG. 4 shows the sequence during "Drilling on" with Kelly drilling, in which there is one Coupler (mounted below the normal Rotary table. The swivel (11), Kelly (12), Kelly bushing rotary table (13), Coupler (14) and BOP stack (15). This hand-to-hand method is applicable to most existing drilling rigs.

FIG. 5 shows the sequence during "Drilling on" with Kelly drilling in which there is one Coupler (mounted below an elevated Rotary table. This hand-to-hand method is applicable to most existing drilling rigs.

FIG. 6 shows the sequence during "Drilling on" with Topdrive drilling in which there is one coupler mounted on or below the rig floor. With or without short vertical travel for continuous drilling. The top drive is (16). This hand-to-hand method is applicable for all rigs using top drives.

FIG. 7 shows the sequence during "Drilling on" with Top drive drilling in which there is one coupler integrated with the BOP stack. With downhole bumpersub for continuous drilling. This hand-to-hand method is-applicable for all rigs using top drives.

FIG. 8 shows the sequence during "Drilling on" with Top drive drilling in which there is one coupler mounted on a short hoist. This hand-to-hand method is applicable for existing rigs with top drives.

FIG. 9 shows the sequence during "Drilling on" with Bottom drive (17) drilling in which there is one coupler mounted on a short hoist. This hand-to-hand method is applicable for a new rig design eliminating drawworks.

FIG. 10 shows the sequence during "Drilling on" with mobile rotary table (18) in which there is one coupler mounted on a short or long hoist plus rotary table on a long hoist. This hand-to-hand method is applicable for a new rig design eliminating drawworks.

FIG. 11 shows the sequence during "Drilling on" without top or bottom drives in which there are two identical couplers (A) and (B) with split bodies (mounted on long hoists). This hand-over-hand method is applicable for a new rig designs only.

Figure 12:
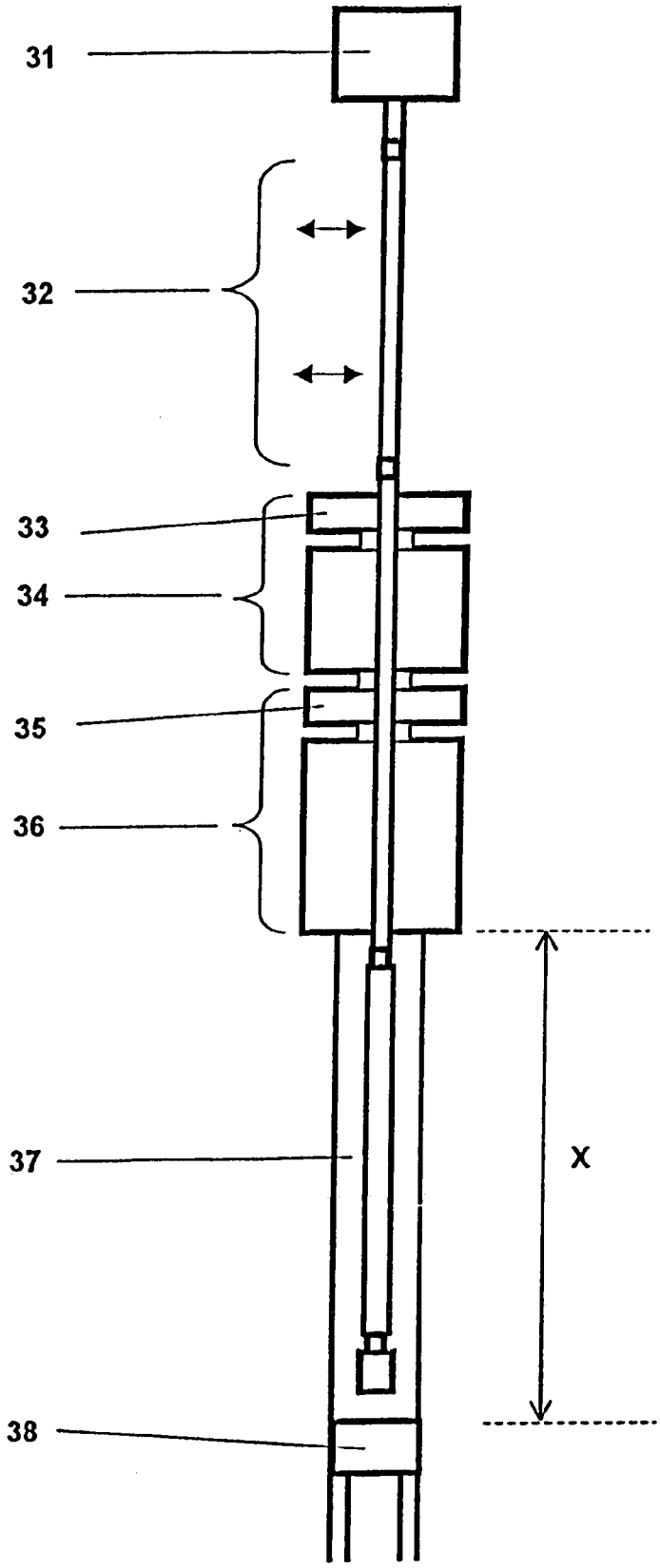

Referring to FIG. 12 a wellhead drilling assembly consists of a standard BOP stack (36), with a stack RBOP (35). Above this is connected the coupler (34) consisting of a lower RBOP (if considered necessary), a lower grips and slips unit (34), a blind ram (or diverter) and an upper grips and slips unit onto which is connected the upper RBOP (33). There is a downhole diverter (38) which creates the chamber (37) and the distance X can be as much as 300 ft or more.

Above this is positioned the pipe handling equipment, (if required) (32) and top drive (or rotary table in Kelly drilling) (31).

Referring to FIG. 13, this shows the position of the threads on the tubular and string when they are bought together. FIGS. 13*a* and 13*b* shows the two situations to be avoided and FIG. 13*c* indicates the range of overlap to be achieved that will produce neither too little an overlap of the teeth to avoid overstressing the teeth nor too little a clearance with the teeth above to avoid collision. In FIG. 13*a* there is too little overlap to avoid high stress, in FIG. 13*b* there is too little clearance to ensure passing when landing. In FIG. 13*c* there is a safe range of overlap that will neither overstress a tooth nor collide with the tooth above on landing.

What is claimed is:

1. A system comprising:

(a) first and second couplers;

(b) first and second hoist means connected to said first and second couplers for raising and lowering said first and second couplers individually; and (c) power means for raising and lowering said hoist means for performing hand-overhand motions of said first and second couplers.

2. A system as claimed in claim 1 wherein said power means raise and lower said first and second couplers and moves them horizontally in alternate steps to perform said hand-over-hand motions of said couplers.

3. A system comprising:

(a) first and second couplers;

(b) first and second hoist means connected to said first and second couplers for raising and lowering said first and second couplers individually; and (c) power means for raising and lowering said hoist means for raising and lowering said first and second couplers and move them horizontally in alternate steps to perform hand-over-hand motions of said couplers.

4. The system of claim 3 including:

(a) a well head;

(b) a BOP stack mounted above said well head;

(c) said couplers comprising fluid-tight chambers;

(d) each coupler including an upper annular seal;

(e) each coupler including upper grip means for engaging a tubular and lower grip means for engaging a drill string;

(f) each coupler including divider means forming two portions in said chamber;

(g) each coupler including lower grip means and slip means for engaging a drill string to which said tubular is to be connected and lower annular preventers.

5. A system comprising:

(a) first and second couplers;

(b) first and second hoist means connected to said first and second couplers for raising and lowering said first and second couplers individually; and (c) power means for raising and lowering said hoist means, and moving them horizontally for performing hand-over-hand motions of said first and second couplers.

6. The system of claim 5 wherein each of said first and second couplers include sealed housings and means for introducing drilling fluid into said housing.

7. A system comprising:

(a) first and second couplers;

(b) first and second hoist means connected to said first and second couplers for raising and lowering said first and second couplers individually;

(c) power means for raising and lowering said hoist means for performing hand-over-hand motions of said first and second couplers;

(d) each of said first and second couplers including fluid sealed housings and means for introducing and evacuating drilling fluid from said housings;

(e) upper slip means connected to each of said couplers for securing a tubular against upward movement;

(f) openable and closeable divider means in said housings defining upper and lower chambers in said housing; and (g) means of moving said tubular downwardly into rotational contact with said drill string for securing said tubular and said drill string together.

8. The system of claim 7 in combination with a rotary table, and in which said coupler is positioned below said rotary table.

9. The coupler of claim 7 including power means for opening said divider means for a distance sufficient for said upper slip means and said upper grip means to pass through said divider means.

10. The coupler of claim 7 including means for rotating an individual tubular and said drill string in relatively opposite directions.

11. The coupler of claim 10 wherein said means for rotating said tubular and said drill string rotate in the same direction at differential speeds.

12. The coupler of claim 7 including upper and lower grip means connected to each of said housings for gripping said tubular and said drill string respectively.

13. The system of claim 12 including upper slip means for securing a tubular against upward movement.

14. The system of claim 13 wherein each of said couplers include openable divider means and power means for opening said divider means a distance sufficient to pass said upper slip means.

15. The system of claim 7 in combination with:

(a) a well head;

(b) a BOP stack mounted above said well head;

(c) said couplers comprising fluid-tight chambers;

(d) each coupler including an upper annular preventer;

(e) upper grip means for engaging a tubular and lower grip means for engaging a drill string;

(f) blind ram preventers or diverters positioned in said chambers;

(g) each coupler including lower grip means and slip means for engaging a drill string to whichsaid tubular is to be connected.

* * * * *